United States Patent [19]

Rojey et al.

[11] 4,406,135

[45] Sep. 27, 1983

[54] HEATING AND THERMAL CONDITIONING PROCESS MAKING USE OF A COMPRESSION HEAT PUMP OPERATING WITH A MIXED WORKING FLUID

[75] Inventors: Alexandre Rojey, Garches; Claude Ramet, Paris, both of France

[73] Assignee: Institut Francais du Petrole, Rueil-Malmaison, France

[21] Appl. No.: 339,565

[22] Filed: Jan. 15, 1982

[30] Foreign Application Priority Data

Jan. 15, 1981 [FR] France ..... 81 00847

[51] Int. Cl.[3] ..... F25B 00/00

[52] U.S. Cl. ..... 62/114

[58] Field of Search ..... 62/115, 114, 238.6, 62/93, 272

[56] References Cited

U.S. PATENT DOCUMENTS

| | | | |
|---|---|---|---|
| 3,203,194 | 8/1965 | Fuderer | 62/114 |
| 3,889,485 | 6/1975 | Swearingen | 62/114 X |
| 4,089,186 | 5/1978 | Rojey et al. | 62/114 X |
| 4,167,101 | 9/1979 | Rojey | 62/114 |
| 4,341,084 | 7/1982 | Rojey et al. | 62/114 X |
| 4,344,292 | 8/1982 | Rojey | 62/114 |

*Primary Examiner*—Lloyd L. King

*Attorney, Agent, or Firm*—Millen & White

[57] ABSTRACT

A heating and thermal conditioning process makes use of a compression heat pump operated with a mixed working fluid consisting of a non-azeotropic fluid mixture, wherein the compressed mixture. The compressed fluid mixture is completely condensed by heat exchange with an external fluid and then sub-cooled. The sub-cooled fluid is then expanded and partially vaporized, and the partially vaporized fraction is used as a sub-cooling agent for the condensed fluid mixture in a heat exchange having also the effect of completing said vaporization to produce a gaseous mixture whch is again compressed in a new cycle of operation of the heat pump.

12 Claims, 3 Drawing Figures

HEATING AND THERMAL CONDITIONING PROCESS MAKING USE OF A COMPRESSION HEAT PUMP OPERATING WITH A MIXED WORKING FLUID

BACKGROUND OF THE INVENTION

This invention relates to a process for heating and thermal conditioning by means of a compression heat pump operating with a mixed working fluid.

The use, in a compression heat pump, of a mixed, nonazeotropic working fluid which vaporizes or condenses, at a given pressure, within a temperature range and not at a fixed temperature, makes it possible to improve the performance coefficient of the heat pump.

By mixed, non azeotropic, working fluid, is meant a mixture of at least two individual fluids capable of vaporizing or condensing within the working range of the pump without forming any azeotrope with one another, particularly of two chemically distinct individual fluids (A) and (B) forming no azeotrope with each other within the working range of the pump, or an individual chemical (A) with an azeotrope (C) comprising two or more other individual chemicals, azeotropically independent from the chemical (A), or even two azeotropes (C') and (C'') independent from each other.

In a certain number of applications, the heat which is supplied to the evaporator is available within a relatively narrow temperature range, for example smaller than 10° C., or even in some cases, smaller than 5° C. on the other hand the heat must be delivered from condenser within a relatively larger temperature range, for example, larger than 10° C. or even in some cases larger than 15° C.

In such cases, the use of a mixed working fluid which condenses according to a temperature profile parallel to the temperature profile of the external fluid heated by the heat pump and in a temperature range close to the range of temperature evolution of said external fluid, (by a temperature range close to another temperature range are meant two ranges of similar width, irrespective of the thermal level concerned), does not provide for a substantial improvement as compared with the use of a pure substance since, in the evaporator, the mixture generally vaporizes within a temperature range close to the temperature range wherein it is condensed and which, although close to the range of temperature evolution of the external fluid heated by the heat pump, is far larger than the range of temperature evolution of the external fluid from which the heat pump takes heat.

In this case the mixed fluid is not well adapted to its operating conditions in the evaporator and does not bring any noticeable gain as compared with a pure substance.

SUMMARY OF THE INVENTION

The process according to the invention makes it possible to improve the performances which may be obtained in such a case when a mixed fluid is used. In accordance with the process the evaporation is effected in at least two steps. At least a first step which consists of exchanging heat with the external fluid forming the heat source, and at least a second step which consists of exchanging heat with the liquid mixture issued from the condensation stage. The fraction of the mixture which is vaporized during the second step must be at least 5% of the total fluid vaporized in both steps, in order that the process according to the invention results in a noticeable gain. This fraction is practically from 5 to 40% by mole. In most cases the fraction of the mixture vaporized during the first step is from 60 to 95% by mole of the total amount vaporized in both steps.

DETAILED DISCUSSION OF THE INVENTION

Figure 1:
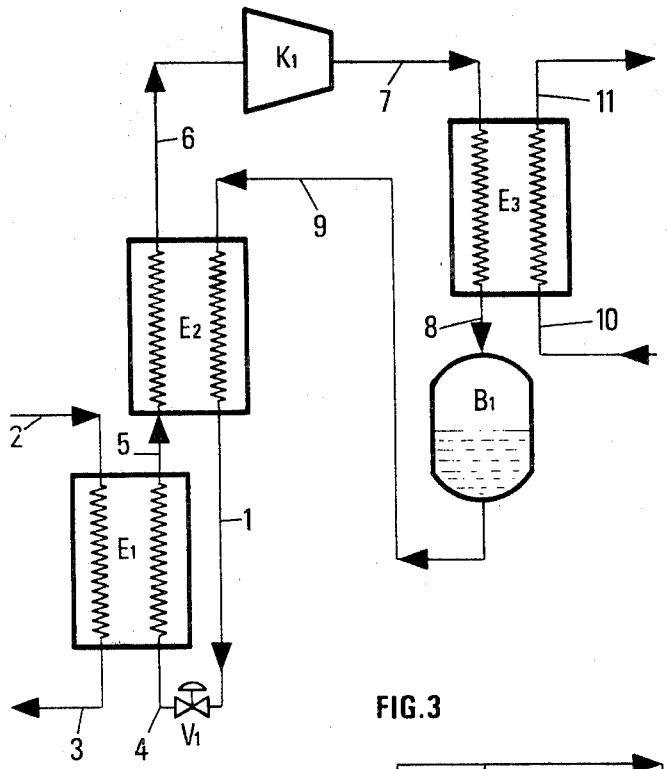
FIG. 1 is a schematic diagram of one embodiment for carrying out the process of the invention.

The invention will be described more completely with reference to FIG. 1, which illustrates, by way of example, one embodiment of the process according to the invention.

In this embodiment the mixture is supplied in the liquid phase through line 1. It is expanded through the expansion valve V1, fed through line 4 to exchanger E1, and partially vaporized in exchanger E1 by taking heat from an external fluid supplied through line 2 and discharged through line 3. The liquid-vapor mixture issued from exchanger E1 is fed through line 5 to exchanger E2 wherefrom it is discharged in a completely vaporized state and optionally overheated, through line 6. It is compressed in compressor K1 and the compressor vapor phase mixture is fed through line 7 to exchanger E3 where it is condensed by transferring heat to an external fluid supplied through line 10 and discharged through line 11. The mixture is expelled from exchanger E3 through line 8 and enters the drum B1. Through line 9, the liquid phase is fed to exchanger E2 where it is cooled while supplying the heat required to complete the vaporization and optionally to overheat the mixture supplied through line 5 and discharged through line 6.

In order to take maximum advantages of the process of the invention, the composition of the mixture must be selected so that the temperature range during the condensation is close to the difference between the input and output temperatures of the external fluid which is heated in the condenser. Thus, for example, when the mixture is a binary mixture consisting of a first major constituent and a second minor constituent, it is known that the temperature range during the condensation at a given pressure increases with the proportion of said second constituent, and consequently, when the two constituents have sufficiently different vaporization temperatures in a pure state and under the same pressure, a given condensation temperature range corresponds to a well defined composition. It is also possible to select the composition of a mixture having more than two constituents in a manner such as to obtain, at a certain pressure, a given temperature range during the condensation by making use of constituents having sufficiently different boiling temperatures in a pure state and under the same pressure.

On the other hand, in order to take the maximum advantage of the process of the invention, it is also desirable that the working fluid be supplied to the compressor in a completely vaporized state. For this purpose, the expansion valve V1 must provide a pressure, after expansion, such that the mixture is completely vaporized at the output from exchanger E2.

This condition makes apparent one of the advantages of the process of the invention. It provides for the operation with a temperature at the end of the vaporization stage and a pressure higher than those which are effective in the case of the usual techniques requiring a complete vaporization at the output of exchanger E1. It makes it possible, on the other hand, that the input in expansion valve V1 is at a much lower temperature than the output temperature of condenser E3, thereby reducing the fraction vaporized by the expansion. It is thus possible to bring the beginning vaporization temperature of the mixture nearer to the bubble temperature and thus, to further improve the conditions of thermal exchange in exchanger E1. The pressure increase at the compressor input provides two advantages: (1) it makes possible to improve the performance coefficient by reducing the compression rate, and (2) to increase the thermal capacity of the heat pump by reducing the molar volume at the suction point.

This second advantage is of particular importance when it is desired to reduce the investment corresponding to a given installation. In order to obtain the complete benefit thereof it is essential that the mixed working fluid at the output of condenser E3 be entirely condensed. As a matter of fact, it is observed, when the condensation is partly effected in exchanger E2, even if the fraction condensed in exchanger E2 is small, that for a given thermal power, an increase in the suction rate by volume and, consequently, of the required compressor size results. Practically, it is therefore generally convenient to place the reserve tank B1 at the output of the condenser E3 and then to collect the mixed working fluid in the liquid phase through line 9 and to sub-cool it in exchanger E2.

Finally, the device of the invention is characterized in that:

(a)-the mixed working fluid is compressed in the vapor phase, (b)-the compressed mixed fluid issued from step (a) is contacted in thermal exchange relationship with a relatively cold external fluid, and said contact is maintained up to the substantially complete condensation of said mixed fluid, (c)-the substantially completely condensed mixed fluid issued from step (b) is contacted in thermal exchange relationship with a cooling fluid as defined in step (f), so as to further cool said mixed fluid, (d)-the cooled mixed fluid issued from step (c) is expanded, (e)-the expanded mixed fluid issued from step (d) is contacted in thermal exchange relationship with an external fluid which forms the heat source, the conditions of contact providing for the partial vaporization of said expanded mixed fluid, (f)-the partially vaporized mixed fluid issued from step (e) is contacted in heat exchange relationship with the substantially entirely liquefied mixed fluid fed to step (c), said partially vaporized mixed fluid forming the cooling fluid of said step (c), with the contact conditions being such as to complete the vaporization partially effected in step (e), and (g)-the vaporized mixed fluid issued from step (f) is fed back to step (a).

The process of the invention may be operated in a relatively simple manner since it does not require any by-pass on the main circuit or any additional regulation means. A preferred embodiment comprises one or more of the following adaptations:

1-Adaptation of the mixed fluid to the temperature range of the external fluid heated in the condenser.

2-Adjustment of the expansion means so as to obtain after maximum expansion the pressure level(s) compatible with a complete vaporization of the mixture before its supply to the compressor.

The process according to the invention is thus particularly well adapted to a heat pump making use of air as heat source, which may be either an air/air heat pump or an air/water heat pump.

Figure 2:
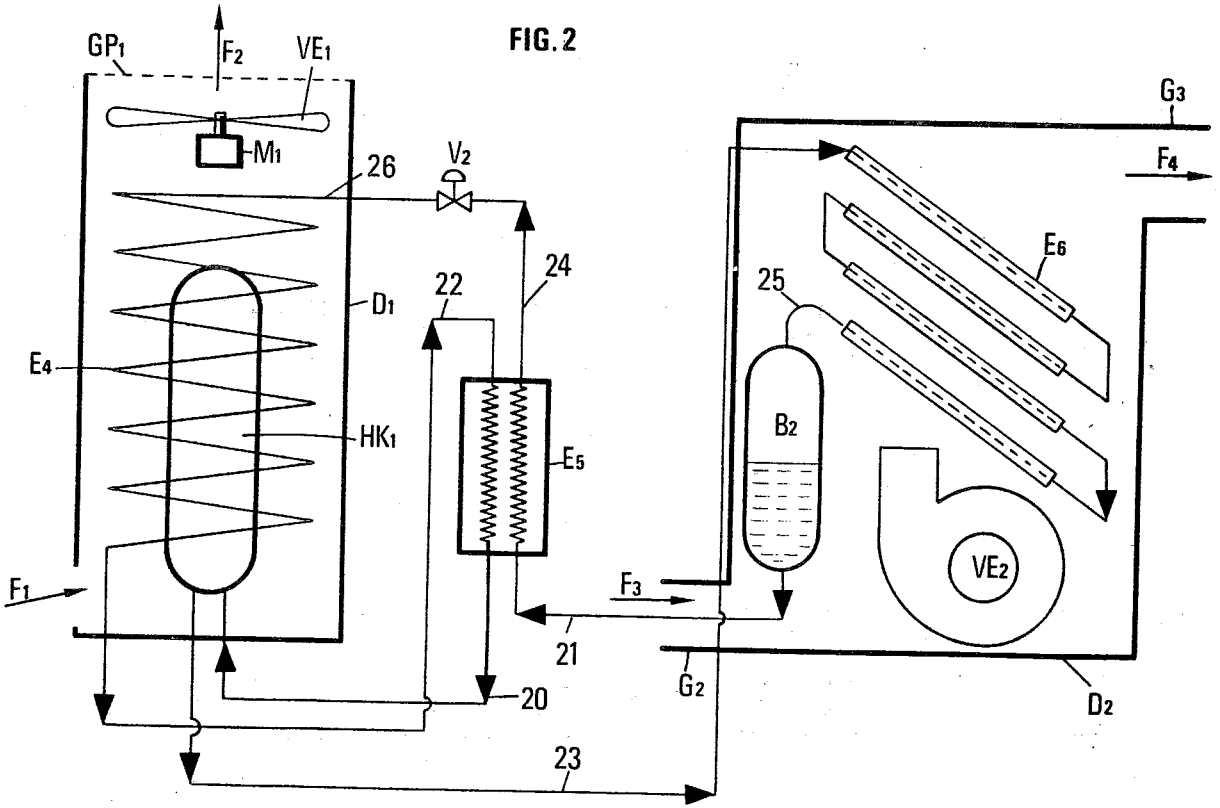
FIG. 2 is a schematic diagram of another embodiment wherein the process of the invention is operated as an air/air heat pump for domestic heating.

In FIG. 2 is shown an operating diagram according to the invention of an air/air heat pump, used for domestic heating, which is illustrated in more detail by example 2. The caisson D1 in contrast with caisson D2, is located outside of the building to be heated, (i.e., split system), but it is clear that the process of the invention may be operated with a one piece installation.

The expanded mixture is partially vaporized in evaporator E4 where it circulates, as a whole, counter-currently with outside air (F1, F2). This outside air is sucked or drawn in at the base of enclosure D1 through the helicoid blower VE1 driven by electric motor M1, and is expelled outside through the protection grid GP1. The evaporator E4 may be made up of, for example, a tube having fins or pins, in order to improve the exchange, and wound as a spiral. The liquid-vapor mixture issued from evaporator E4 through line 22 completes its vaporization in exchanger E5 in contact with the mixture issued from line 21, and is discharged from exchanger E5 through line 20 in an overheated state. It then passes through the tight compressor HK1 wherefrom it is discharged under pressure through line 23. It then enters exchanger E6 wherein it is condensed while heating the air of a building, with this air (F3, F4) being sucked or drawn through the centrifugal blower VE2 at the base of enclosure D2. The exchanger E6 is made up of several separated batteries which are serially traversed by the mixture circulating as a whole downwardly in counter-current flow with the air. The latter is sucked or drawn through the admission sheath G2, and is discharged from enclosure D2 through the exhaust sheath G3 and thus circulates upwardly. The condensed mixed fluid is discharged through line 25 and is recovered in drum B2. The liquid mixed fluid is discharged through line 21 and is sub-cooled in exchanger E5 while heating the mixed fluid which vaporizes. It is conveyed through line 24 up to the expansion valve V2, wherefrom it is fed through line 26 to evaporator E4.

On the other hand, such an installation may take heat from outside air, but also from the extracted air or from a combination of external air and extracted air. In the latter case, the points of introduction of extracted air and of outside air may be different.

The process according to the invention may also be performed in a heat pump for heating water making use of air as the heat source. In this case the condensor of the heat pump may consist, for example, of a double tube exchanger operating counter-currently.

When the range of temperature variation of the external fluid, which is heated in the condensor of the heat pump, is particularly large as compared to the range of temperature variation of the external fluid used as heat source for the evaporator of the heat pump, it is possible to reduce the vaporization range by effecting the vaporization stage at two successive pressure levels. Such an arrangement is effected in the operational diagram shown in FIG. 3, and illustrated in detail by example 3.

The mixed working fluid is partially vaporized at a first pressure level P1 in exchanger E10, wherein it enters through line 30 and is discharged through line 31. The heat exchange in E10 is effected with a first fraction of the external fluid constituting the cold source, supplied through line 43 and discharged through line 44. The vaporization of the mixed fluid continues in exchanger E11, in which the mixed fluid is supplied as a liquid-vapor mixture through line 31, flows out through line 32 and takes its vaporization heat from the liquid mixed fluid which circulates counter-currently, enters E11 through line 41 and flows out through line 42. The liquid-vapor mixture is discharged through channel 32 in drum B3, wherein the liquid and vapor phases separate. The vapor phase is discharged through tube 33 and is sucked or drawn, still at pressure P1, into an intermediary stage of compressor K2. The described arrangement thus implies that the compression is effeced in at least two stages.

At the output from B3, the liquid phase is discharged through line 34, sub-cooled in exchanger E12, then fed through line 35 to the expansion valve V4, wherefrom it is expanded to the cycle low pressure P2, which is lower than P1. After expansion through V4, the mixed fluid is then fed through line 36 to exchanger E13 and is discharged therefrom as a liquid-vapor mixture through line 37. The exchanger provides for the partial vaporization of the mixed fluid at pressure P2, by taking heat from a second fraction of external fluid extracted from the cold source, supplied through tube 45, and discharged through tube 46.

The end of the vaporization of the mixed fluid, with an optional overheating is effected in exchanger E12; the partially vaporized mixed fluid is fed to E12 through line 37, flows out through line 38 and takes the heat required for completing the vaporization from the sub-cooled liquid which is supplied through line 34 and discharged through line 35.

The pressure levels P1 and P2 obtained by means of the expansion means V3 and V4 are adjusted so that the temperature of the liquid-vapor mixture at the inlet of exchanger E13 is close to the temperature of the liquid-vapor mixture at the inlet of the exchanger E10. It is thus clear that the temperature range between the beginning and the end of the vaporization is narrow. A direct consequence is that, instead of the need to compress the entire vapor mixture from the starting pressure level P2, it is possible to compress a fraction of said vapor mixture from the intermediary pressure level P1 higher than P2.

The mixed fluid, vaporized at pressure P2, is discharged to the first stage of compressor K1 through line 38; it is admixed during the compression with the mixed fluid vaporized at pressure P1 and sucked or drawn through line 33. The final mixture is discharged from K2 through channel 39 at pressure P3 which is the cycles high pressure ($P3 > P1 > P2$). It is then condensed in exchanger E14 while transferring its overheat to the external fluid which is supplied countercurrently through line 47 and is discharged through line 48.

The mixed fluid, after condensation, is collected through tube 40 in a storage drum B4. The liquid mixed fluid is discharged through line 41, sub-cooled in exchanger E11, then fed through line 42 to the valve V3, wherethrough it is expanded to the cycle intermediate pressure P1.

Different mixtures may be used as the mixed working fluid, provided that they do not form an azeotrope under the operating conditions of the heat pump. The mixture may be formed, for example, of a mixture of hydrocarbons or of halogenated hydrocarbons of the "Freon" type, or still of alcohols, ketones, esters, ethers, amines. It may be advantageous, particularly in the installations operating at relatively high temperatures, to make use of a mixture of water with a water soluble constituent such as ammonia or methanol.

A particularly important field of application of the process according to the invention concerns its application to the heating of buildings and particularly the heat pumps equipping dwellings. The invention is also applicable to installations which are used as a heat pump in winter, and for air conditioning in summer, and wherein the change from the "winter" operating conditions to the "summer" operating conditions is obtained for example by making use of an inversion valve according to a well known principle in air conditioning. The process according to the invention corresponding to diagram 3 is adapted to such applications as those of the industrial or collective heating type, wherein the temperature variation of the heating fluid is substantially greater than the cooling of the fluid from the cold source.

In the building heating or conditioning installations, for sake of security, the mixture used is generally a mixture of constituents of the "Freon" type. The mixture may thus consist of binary mixtures comprising a major constituent such as monochlorodifluoromethane (R-22), dichlorofluoromethane (R12), chloropentafluoroethane (R-115) or still, an azeotropic mixture such as R-502, i.e., an azeotrope of R-22 with R-115, and a second constituent such as trichlorofluoromethane (R-11), dichlorotetrafluoroethane (R-114), dichlorohexafluoropropane (R-216), dichlorofluoromethane (R-21), monochlorotrifluoromethane (R-13), trifluoromethane (R-23), trifluorobromomethane (R-13B1). Specific examples are as follows:

R-22+R-11
R-22+R-114
R-12+R-13
R-502+R-114

The adjustment of the expansion means placed before the evaporator must be effected in accordance with the composition of the mixture. In the heat pumps used for heating buildings, the pressure reducer is generally provided with a bulb which contains the cooling agent used as working fluid. The pressure obtained on the expansion side is such that the same cooling agent at the bulb temperature is overheated by 5° to 15° C.; with this overheating being regulated by adjusting the calibration of the pressure reducer. The same type of pressure reducer may be used in the case of a mixture. The pressure after expansion must however, be adjusted so that the mixed working fluid is only partially vaporized during the exchange with the external fluid used as heat source, and issues slightly overheated from the exchanger wherein it takes the heat from the mixture flowing out from the condenser. This adjustment may be effected by acting both on the calibration of the pressure reducer and on the position of the bulb, as well as on the nature of the fluid filling the bulb which may be for example R-22 or R-12. The bulb may be placed at different points and balanced in temperature with the mixed working fluid for example at the end of stage (e) or at the end of stage (f) or at the end of stage (c) or still at an intermediary point of any one of these stages.

It can be understood that it is possible either to increase the pressure when the overheating at the end of stage (f) is excessive by displacing the bulb towards a point where the temperature is higher, or to decrease the pressure by displacing the bulb towards a point whose temperature is lower. By such an arrangement it is possible to obtain an automatic regulation of the pressure in the evaporator in response to a variation in the external temperature.

The operating conditions are generally selected so that the pressure of the mixture in the evaporator is higher than the atmospheric pressure and the pressure of the mixture in the condenser does not reach values which are too high, for example, higher than 30 bar.

The input temperature of the external fluid which is used as heat source is generally higher than 0° C. during at least a portion of the operating period of the heat pump during the year.

The apparatus for carrying out the process may be constructed by using different equipment for each of the components.

Thus, the exchanger wherein is effected the final vaporization step by exchange with the mixture flowing out from the condenser, may be, for example, a double tube exchanger, different types of fins being optionally introduced either in the one or more internal tubes, or in the annular space between the one or more internal tubes and the external tube. In this case, it may be advantageos to circulate the mixture flowing from the condenser through the one or more internal tube(s) so as to obtain higher flow velocities.

The exchanger may also consist of plane plates or may be a spiral exchanger, the only condition to be fulfilled being the achievment of heat exchange conditions as close as possible to a true counter-current exchange.

The exchangers in contact with the external fluids, i.e., the evaporator and the condenser, may also be of any type, provided that they are adapted to the nature of the external fluid with which the exchange is effected.

The compressor may, for example, consist of a lubricated piston compressor, of tight type or open type, a dry piston compressor or, for higher powers, a screw compressor or a centrifugal compressor.

Figure 3:
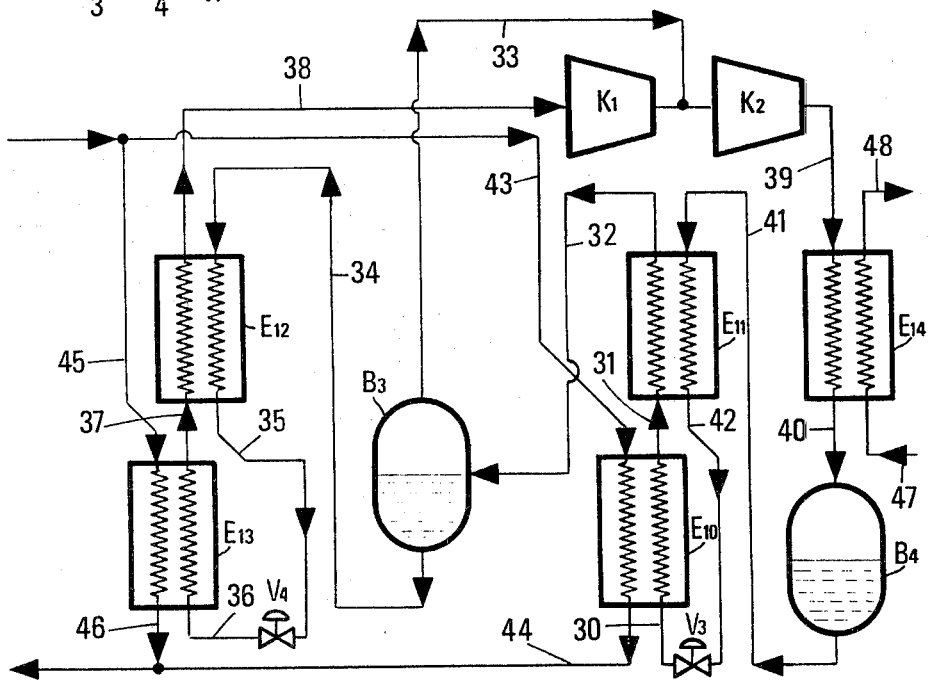
FIG. 3 is a schematic diagram of still another embodiment of a mode of operation according to the invention.

FIGS. 1, 2 and 3, which illustrate the invention, are only schematic diagrams and do not include some secondary elements which may form part of usual installations of heat pumps such as warning lights, drying cartridge, bottle against liquid hammer at the compressor inlet, etc. . . .

The following examples illustrate the operation of the process according to the invention.

EXAMPLE 1

Example 1 is illustrated by FIG. 1. The cold source consists of water extracted from a groundwater table. This water is fed at a flow rate of 1500 l/h to evaporator E1 through line 2 at a temperature of 12° C., and flows out from evaporator E1 through line 3 at a temperature of 5° C. The heating water supplied to condenser E3 at a rate of 1000 l/h is supplied through line 10 at a temperature of 21.3° C. and is discharged through line 11 at a temperature of 34.5° C.

The working fluid is a binary mixture having the following molar composition:

| | |
|---|---|
| R-22 (chlorodifluoromethane): | 0.94 |
| R-11 (trichlorofluoromethane): | 0.06 |

The mixture flows out from evaporator E1 at a temperature of 3.5° C. The vaporized molar fraction at the outlet from E1 is 0.86. The mixture is finally vaporized in exchanger E2 at a temperature of 9.3° C. It is observed that the use of exchanger E2 wherein the mixture issued from evaporator E1 is finally vaporized, and wherein the mixture issued from the reserve tank B1 is sub-cooled, results both in an increase in the performance coefficient by 6.1% and in the reduction of the suction rate per volume of the compressor by 4.4%, as compared with an identical installation not including exchanger E2 and operating with the same mixture.

EXAMPLE 2

Example 2 is illustrated by FIG. 2. The evaporator E4 is fed with external air at a rate of 4864 $m^3/h$ and at a temperature of 8.3° C. This air is discharged at a temperature of 6.3° C. Condenser E6 provides for the heating of 1084 $m^3/h$ of air from the building to be heated, which is fed to condenser E6 at a temperature of 21.1° C. and is discharged at an increased temperature of 33.4° C.

The working fluid is a ternary mixture whose molar composition is as follows:

| | |
|---|---|
| R-22 (chlorodifluoromethane): | 0.91 |
| R-114 (dichlorotetrafluoroethane): | 0.06 |
| R-11 (trichlorofluoromethane): | 0.03 |

The mixture is discharged from evaporator E4 at a temperature of 0.6° C. The molar fraction vaporized at the output of evaporator E4 is 0.85. The mixture is finally vaporized in exchanger E5 at a temperature of 5.1° C. The use of the additional exchanger E5 provides both for an increase by the preformance coefficient by 5.7%, and a reduction of the suction rate by volume of the compressor by 7.4% as compared with an identical installation not including exchanger E5 and operating with the same mixture.

EXAMPLE 3

Example 3 is illustrated by FIG. 3. The heat source for evaporators E10 and E13 consists of water supplied at 40° C. and cooled down to 33° C. The water flows through the evaporators E10 and E13 at an identical rate equal to 75 $m^3/h$. The heating fluid which is heated in condenser E14 is water supplied to condenser E14 at a temperature of 45° C., and which is heated up to a temperature of 82° C. Its flow rate is 35 $m^3/h$. The working fluid is an equimolar binary mixture of dichlorodifluoromethane (R-12) and trichlorotrifluoroethane (R-113). The compressor is of the two stage centrifugal compressor type. In the first stage the vapor mixture is sucked or drawn under a pressure of 1.31 bar, and expelled at an intermediary pressure of 2.49 bars. In the second stage, the mixture issued from the first stage and the mixture supplied from line 33 are compressed up to a final pressure of 6.54 bars.

The sub-cooled liquid mixture discharged from exchanger E11 through line 42 begins to vaporize in evaporator E10. By comparison with the liquid flow rate through line 41, it is observed that, at the output of evaporator E10, the vaporized fraction is 0.4 by mole; at the output of evaporator E11 it is 0.5 by mole; at the output of the evaporator E13 the vaporized fraction is, as a total, 0.8 by mole (i.e. 0.3 in evaporator E13). The vaporization is completed in evaporator E12.

The condensation range in exchanger E14 is 39° C. whereas the vaporization ranges at low pressure (vaporization effected in exchangers E13 and E12) and at intermediary pressure (vaporization in exchangers E10 and E11) are close to 18° C. It is thus observed that the arrangement diagrammatically shown in FIG. 3 makes it possible to recover heat over a temperature range much narrower than the temperature range at which it is supplied, by effecting the heat exchange under good conditions of reversibility. As a result thereof, there is obtained an increase in the performance coefficient which, in the considered example, is about 25% higher than in the case of a cycle comprising a single evaporator and making use of the same mixture.

What is claimed is:

1. A heating and thermal conditioning process wherein a compression heat pump is operated with a mixed working fluid under such conditions that the mixture of constituents forming the mixed working fluid does not form any azeotrope, comprising the steps of:

(a) compressing the mixed working fluid in vapor phase, (b) contacting in heat exchange relationship the compressed mixed fluid issued from step (a) with a relatively cold external fluid, and maintaining said contact up to the substantially complete condensation of said mixed fluid, (c) contacting in heat exchange relationship, the substantially completely condensed mixed fluid issued from said (b) with a cooling fluid as defined in step (f) hereinafter, so as to further cool said mixed fluid, (d) expanding the cooled mixed fluid issued from step (c), (e) contacting the expanded mixed fluid issued from step (d), in heat exchange relationship, with an external fluid constituting a heat source, the conditions of the contact providing for the partial vaporization of said expanded mixed fluid, (f) contacting said partially vaporized mixed fluid issued from step (e), in heat exchange relationship, with the substantially completely liquified mixed fluid fed to step (c), said partially vaporized mixed fluid forming the cooling fluid of said step (c), with the contact conditions providing for the completion of the vaporization initiated in step (e), and (g) feeding back to step (a) the vaporized mixed fluid issued from step (f), the process operating under such conditions that the temperature range at which the external fluid provides heat to step (e) is narrower than the temperature range at which the external fluid is heated in step (b).

2. A process according to claim 1, wherein the heat exchange between the mixed working fluid of step (f) and the mixed working fluid of step (c) is conducted counter-currently.

3. A process according to claim 1, wherein the molar fraction of the mixed working fluid which is vaporized in step (e) is from 60 to 95%, and that vaporized in step (f) is from 5 to 40%, with respect to the total amount of mixed fluid vaporized in these two steps.

4. A process according to claim 1, wherein the heat exchange in step (b) is conducted counter-currently.

5. A process according to claim 1, wherein the heat exchange of step (e) is conducted counter-currently.

6. A process according to claim 1, wherein the mixed fluid of steps (e) and (f) is only partially vaporized, and which comprises the following additional steps of:

(h) separating the vaporized fraction from the unvaporized fraction and feeding the vaporized fraction to step (a), (i) contacting, in heat exchange relationship, the unvaporized fraction with a cooling fluid as defined in step (1) hereinafter to further cool said unvaporized fraction, (j) expanding the cooled fraction produced in step (i), (k) contacting the expanded fraction produced in step (j), in heat exchange relationship, with an external fluid constituting a heat source, with the contact conditions providing for the partial vaporization of said expanded fraction, (l) contacting the partially vaporized fraction from step (k), in heat exchange relationship, with the unvaporized fraction, as indicated in step (i), said partially vaporized fraction constituting the cooling fluid of step (i), and with the contact conditions providing for the completion of the vaporization initiated in step (k), and (m) feeding back the vaporized fraction issued from step (1) to step (a).

7. A process according to claim 1, wherein said temperature range of step (e) is smaller than 10° C. and said temperature range of step (b) is larger than 10° C.

8. A process according to claim 7, wherein said temperature range of step (e) is smaller than 5° C. and said temperature range of step (b) is larger than 15° C.

9. A process according to claim 1, wherein the mixed working fluid is a non-azeotropic mixture of constituents selected from hydrocarbons and halogenated hydrocarbons.

10. A process according to claim 1, wherein the mixed working fluid comprises one major constituent selected from the group consisting of R-22, R-12, R-115 and R-502 and a second constituent selected from the group consisting of R-11, R-114, R-216, R-21, R-13, R-23 and R-13 B1.

11. A process according to claim 1, wherein the composition of the mixed working fluid is selected so that the temperature range required for its substantially complete condensation in step (b) is close to the difference between the input and output temperatures of the relatively cold external fluid of the same step (b).

12. A process according to claim 1, wherein the expansion pressure is controlled in response to the temperature variations at the output of step (e) so as to partially vaporize the mixed working fluid of step (e) and to complete its vaporization in step (f).

* * * * *